US008189845B2

(12) United States Patent
Mulvey

(10) Patent No.: US 8,189,845 B2
(45) Date of Patent: May 29, 2012

(54) EARBUD COUPLING

(75) Inventor: David Mulvey, San Diego, CA (US)

(73) Assignee: Sperian Hearing Protection, LLC, San Diego, CA (US)

( * ) Notice: Subject to any disclaimer, the term of this patent is extended or adjusted under 35 U.S.C. 154(b) by 1344 days.

(21) Appl. No.: 11/643,268

(22) Filed: Dec. 21, 2006

(65) Prior Publication Data

US 2008/0152163 A1 Jun. 26, 2008

(51) Int. Cl.
*H04R 25/00* (2006.01)

(52) U.S. Cl. ..... 381/380; 381/382; 381/328

(58) Field of Classification Search ..... 381/328, 381/371, 380; 181/135; 128/866, 867; D24/106
See application file for complete search history.

(56) References Cited

U.S. PATENT DOCUMENTS

| | | | | |
|---|---|---|---|---|
| 4,133,984 | A | 1/1979 | Akiyama | |
| D253,723 | S | 12/1979 | Leight | |
| 4,434,794 | A | 3/1984 | Leight | |
| 4,539,708 | A | 9/1985 | Norris | |
| 4,716,985 | A | 1/1988 | Haertl | |
| 4,724,922 | A | 2/1988 | Kalayjian | |
| 4,965,838 | A | 10/1990 | Kamon et al. | |
| 4,981,194 | A * | 1/1991 | Kamon et al. | 181/129 |
| 5,002,151 | A | 3/1991 | Oliveira et al. | |
| 5,048,092 | A | 9/1991 | Yamagishi et al. | |
| 5,654,530 | A | 8/1997 | Sauer et al. | |
| 5,659,156 | A | 8/1997 | Mauney et al. | |
| D435,036 | S | 12/2000 | Koss et al. | |
| 6,938,622 | B2 | 9/2005 | Huang | |
| 6,944,307 | B2 | 9/2005 | Berg | |
| 6,961,440 | B1 | 11/2005 | Schlaegel | |
| 7,548,629 | B1 * | 6/2009 | Griffin | 381/382 |
| 2005/0147269 | A1 * | 7/2005 | Oliveira et al. | 381/382 |

FOREIGN PATENT DOCUMENTS

| | | | |
|---|---|---|---|
| GB | 2 355 129 | A | 4/2001 |
| GB | 2355129 | A * | 4/2001 |
| JP | 2005268990 | | 9/2005 |
| WO | WO 02/084982 | A2 | 10/2002 |

* cited by examiner

*Primary Examiner* — Curtis Kuntz
*Assistant Examiner* — Sunita Joshi
(74) *Attorney, Agent, or Firm* — Conley Rose, P.C.; Kristin Jordan Harkins

(57) ABSTRACT

An earbud coupling has a rear portion forming an earbud mount (14) that easily attaches to a hemispherical earbud (12), and has a front portion forming an in-ear mount (16) that can be pressed into a person's ear canal to hold the coupling to the person while blocking environmental noise. The earbud mount includes a tapered elastomeric sleeve (50) with an internal groove (62) at its rear end. The earbud mount rear end can be expanded to fit around the periphery of the earbud front end to securely attach to the earbud. A plurality of different in-ear mounts or tips can be provided that each can be attached to the front end of the earbud mount, including an in-ear mount (100) that consists of a single integral elastomeric member with at least one flange (205). The earbud mount and in-ear mount can be connected by a shaft (130) with pair of projections (132) on one of the mounts that is inserted into a hole (136) with slots (140) of the other one and turned.

6 Claims, 3 Drawing Sheets

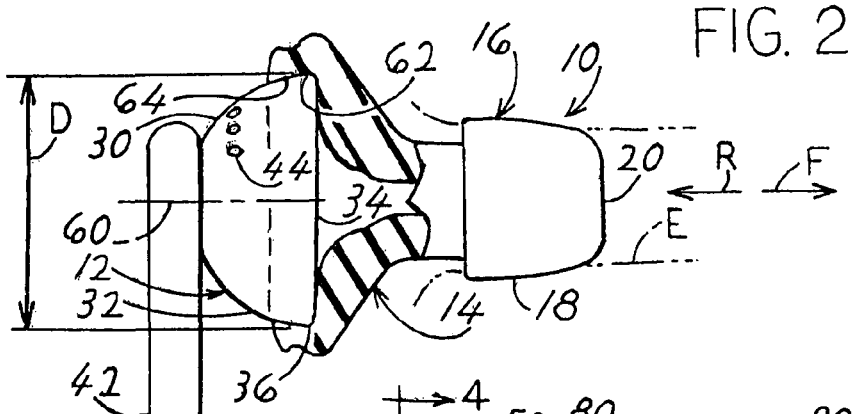
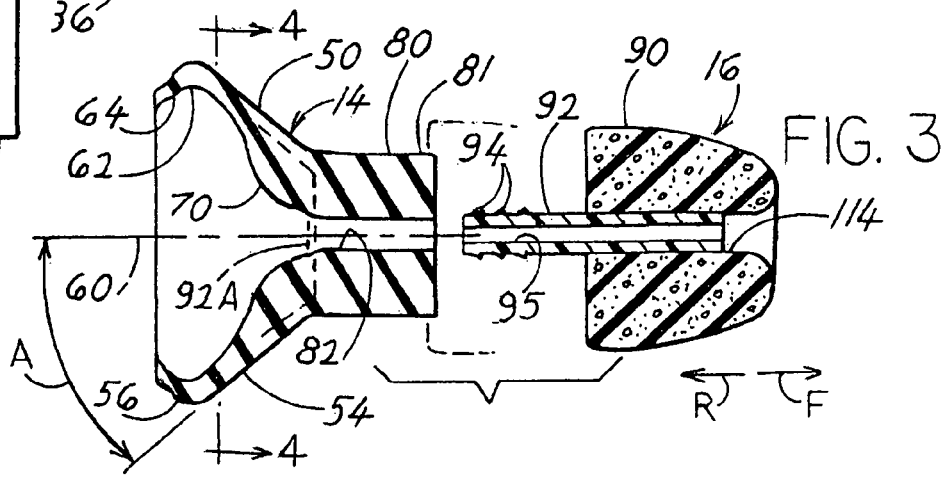
FIG. 3
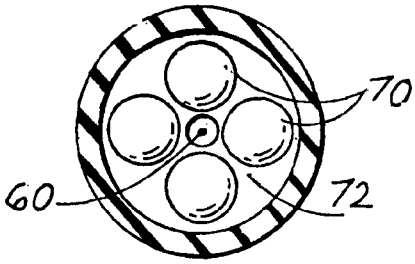
FIG. 4
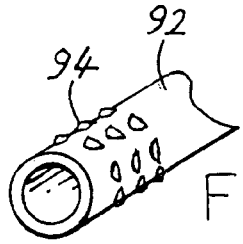
FIG. 5
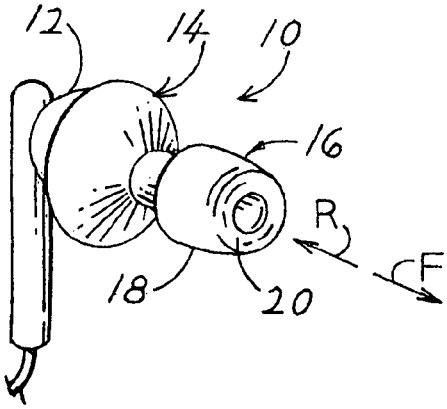
FIG. 1

EARBUD COUPLING

BACKGROUND OF THE INVENTION

Portable devices that deliver sound to a person often include earbuds. Earbuds include small speakers and fit into folds of the human ear that surround the entrance to the person's ear canal. A common popular form of earbud includes a hemispherical housing forming a tapered rear surface and a flat front face with sound passing holes, the rear surface having pressure relief holes. Earbuds usually hold very tenuously to the person's ear, and fall out when the person moves a lot. A device that could hold an earbud securely to a person, and which could block much environmental noise from entering the person's ear canal, would be of value. Such a device should be of low cost and be easy to attach to the earbud. It also would be desirable if any part that fits into a person's ear canal be changeable so a person can select one of a plurality of different parts to suit his/her particular preferences.

SUMMARY OF THE INVENTION

In accordance with one embodiment of the invention, an earbud coupling is provided that can be manufactured at low cost and that can be easily attached to a common type of earbud and to the walls of a person's ear canal. The earbud coupling has a rear portion that forms an earbud mount that mounts to the earbud, and has a front portion that forms an in-ear mount that mounts to the walls of a person's ear canal in the manner of a common earplug.

The earbud mount includes a sleeve of elastomeric material that has a rear end of smaller diameter than the periphery of the front of the earbud. The rear end of the sleeve can be forcefully expanded in diameter to fit around the earbud periphery, with the extreme rear end of the sleeve lying against the tapered rear surface of the earbud. The sleeve is tapered in diameter, with rearward portions of the sleeve being of progressively greater diameter. Also, the rear portion of the sleeve has an internal groove that receives the periphery of the earbud and that securely holds to the earbud.

The in-ear mount, or tip, includes an ear canal blocking portion that fits into the person's ear canal and blocks most sound from reaching the ear canal, except sound from the earbud. Applicant allows any one of a plurality of different in-ear mounts to be attached to the earbud mount. Thus, an in-ear mount with a delayed-recovery soft foam blocking portion can be used. Such mount requires a person to roll the soft foam to a small diameter in the person's fingers before insertion into the ear canal, which makes it undesirable in some circumstances. Another in-ear mount has a flanged blocking portion which is made of molded nonfoam elastomeric polymer. In one arrangement, the rear of the earbud mount has a small diameter passage to receive a small tube that holds a soft foam body of the in-ear mount, and the earbud mount has a rear end with a larger cylindrical hole that can couple to a rear end of a one-piece flanged in-ear mount. In another arrangement, one of the mounts has a shaft with a pair of pins that fit into slots of the other mount, the shaft then turned to look the mounts together.

The novel features of the invention are set forth with particularity in the appended claims. The invention will be best understood from the following description when read in conjunction with the accompanying drawings.

BRIEF DESCRIPTION OF THE DRAWINGS

FIG. 1 is front isometric view of a combination of a prior art earbud and an earbud coupling of the present invention mounted therein.

FIG. 2 is a partially sectional side view of the combination of FIG. 1.

FIG. 3 is an exploded sectional side view of the combination of FIG. 2, but without the earbud.

FIG. 4 is view taken on line 4-4 of FIG. 3, but rotated 45°.

FIG. 5 is a partial isometric view of the rear end of a tube of the earbud coupling of FIG. 3.

DETAILED DESCRIPTION OF THE INVENTION

Figure 10:
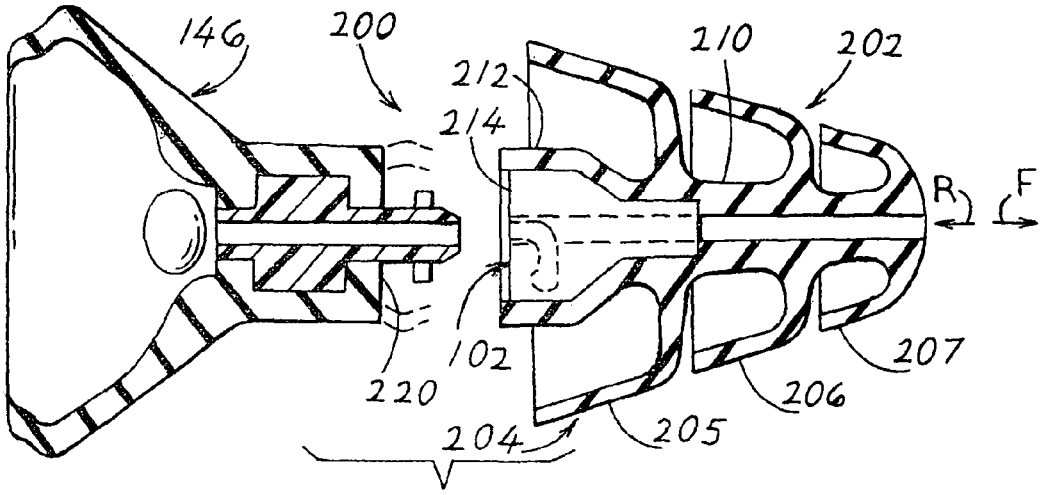
FIG. 10 is an exploded sectional side view of an earbud coupling of another embodiment of the invention wherein the in-ear mount has flanges and is formed of solid elastomeric material.

FIG. 1 shows an earbud coupling 10 of the present invention for use with an earbud 12 such as the type commonly used in the IPOD sold by Apple Computer, to hold the earbud more securely to a person. The earbud coupling has a rear R portion that forms an earbud mount 14 that attaches to the earbud, and has a front F portion that forms an in-ear mount, or tip 16 with a part 18 that fits into the person's ear canal. By fitting into the person's ear canal, the in-ear mount 16 grips the walls of the person's ear canal E (FIG. 2), and at the same time blocks environmental sound from reaching the inner portions of the ear canal. The coupling has passages that allow sound from the earbud 12 to reach the front end 20 of the in-ear mount 16 so the sound enters the inner portion of the person's ear canal.

FIG. 2 shows that the earbud 12 has a frame 30 with a convex rear surface 32 in the shape of a hemisphere and with a front face 34 that is flat, with a peripheral portion or periphery 36 extending around the front face. The earbud contains a speaker (not shown) that receives currents through wires 40 that extend though a guide 42 and into the frame 30. The front face of the frame has holes that allow sound to pass from the speaker forwardly F out of the earbud, and the hemispherical rear surface has pressure relief holes 44 that aid in operation of the speaker.

FIG. 3 shows that the earbud mount 14 has a rear portion forming a tapered sleeve 50 of elastomeric material, with a rear part that can be expanded in diameter to fit around the periphery 36 of the earbud. An elastomeric material is one that has a Young's modulus of elasticity of no more than 50,000 psi. The outside surface 54 of the sleeve extends rearward to the rear part 56 of the sleeve, at a rearward and radially outward incline angle A of about 45° (20° to 60°) with respect to the axis 60 of the earbud and of the coupling. The sleeve rear portion has an internal groove 62 and has a rear end internal surface portion 64 that extends at a rearward and radially inward incline to the axis. When the sleeve is expanded and fitted around the earbud, the groove 62 receives the periphery of the earbud and the reversely tapered rear end internal surface portion 64 lies facewise against the earbud housing tapered surface that extends at a rearward and radially inward incline. The rear end internal surface portion 64 lies forward F of the pressure relief holes 44 of the earbud to leave these holes open.

In an earbud mount that applicant has made and successfully tested for mounting on an earbud of an outside diameter D of 17.2 millimeters, the extreme rear end of the sleeve had an initial (when not deflected) inside diameter of 14 mm and the groove 62 had an inside diameter of 17 mm. Thus, the rear end of the sleeve has a diameter that is only about 15% to 20% (preferably no more than 30%) less than the diameter of the earbud periphery, so the sleeve rear portion has to be expanded very little to fit around the earbud. This allows the use of a sleeve of tough elastomeric material, such as with a Shore A level of about 35 (25 to 50).

As shown in FIG. 4, the inside surface 71 of the sleeve has four part-spherical rearward bumps, or protrusions, 70. As shown in FIG. 2, the protrusions abut the flat front face 34 of the earbud. This leaves regions 72 between protrusions, unobstructed to the passage of sound towards the ear canal.

The earbud mount has a front portion 80 (FIG. 3) with a cylindrical outside surface 81 and with a hole or passage portion 82. The passage portion 82 has a diameter such as 2.6 mm. The passage portion 82 is used to attach to the in-ear mount 16 shown in FIGS. 1-3.

The in-ear mount 16 of FIG. 3 includes a body 90 of slow recovery foam, and a tube 92 of nonelastomeric polymer (Young's modulus over 50,000 psi) with a passage 95 that is aligned with the earbud mount passage or hole 82. A body of slow recovery foam, which is widely used in earplugs, can be rolled in the fingers to a small diameter. Then the body (after attachment to the earbud mount) is inserted into a person's ear canal and kept inserted for about a half minute while it expands to seal against the walls of the ear canal. A disadvantage of slow recovery foam is that it becomes soiled if the person has soiled fingers. An instant recovery foam can be used instead. The tube 92 projects a plurality of millimeters rearward of the body and is designed to be inserted rearwardly R, into the rearward passage portion 82 to the position 92A on the earbud mount. The tube 92 is provided with a roughened surface portion 94, such as with barbs, to hold itself tightly within the front passage, while allowing separation when a large separating force is applied.

The mounts of the earplugs of FIGS. 2-5 are held together by a press fit of one mount to the other. The press fit allows forceful separation as to change the tip. Such press fits where one member is of elastomeric material, are sometimes unreliable, and can result in the tip remaining in a person's ear canal when the earbud and earbud mount are pulled away from a person's ear.

Figure 6:
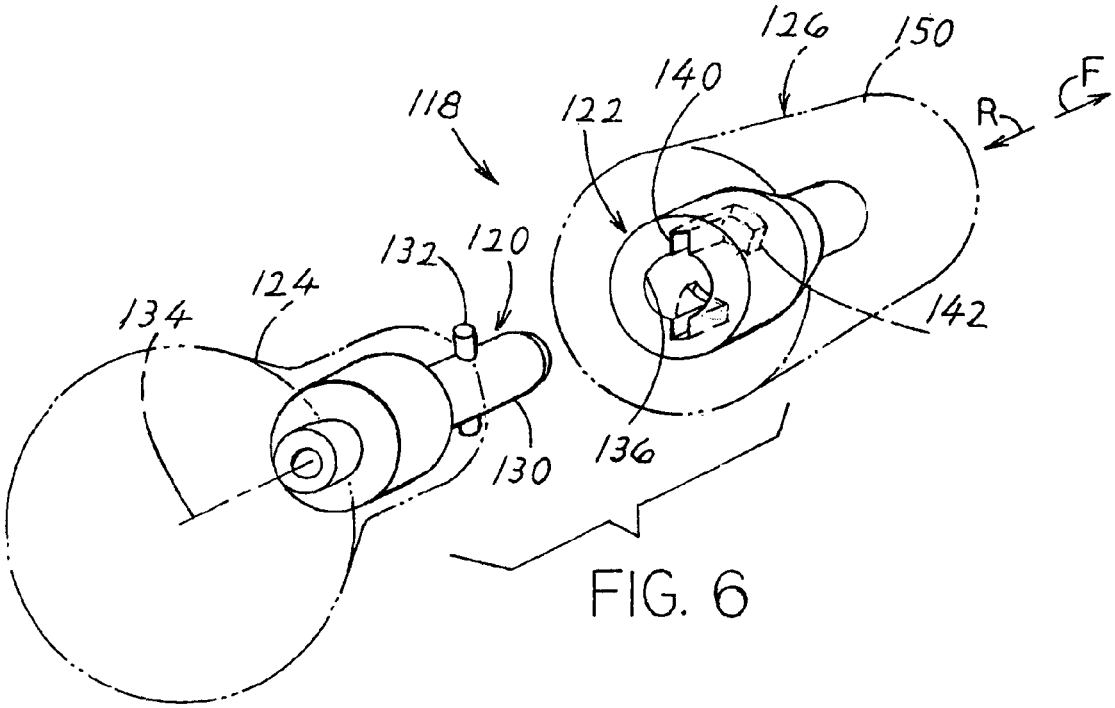
FIG. 6 is an exploded partial isometric view of an earbud coupling of another embodiment of the invention wherein the mounts can be locked together.

FIG. 6 shows an earbud coupling 118 with connectors 120, 122 of the earbud mount 124 and in-ear mount or tip 126 that can be more securely latched together. The earbud mount connector 120 includes a shaft 130 and a pair of pins 132 projecting radially (with respect to axis 134) from the shaft. The shaft can be inserted forwardly F into a hole 136 in the tip connector, with the pins entering slots 140. After insertion the earbud mount connector 120 is turned about the axis 134 by an angle of less than 160° such as 60° and comes to rest in an annular slot extension 142.

Figure 7:
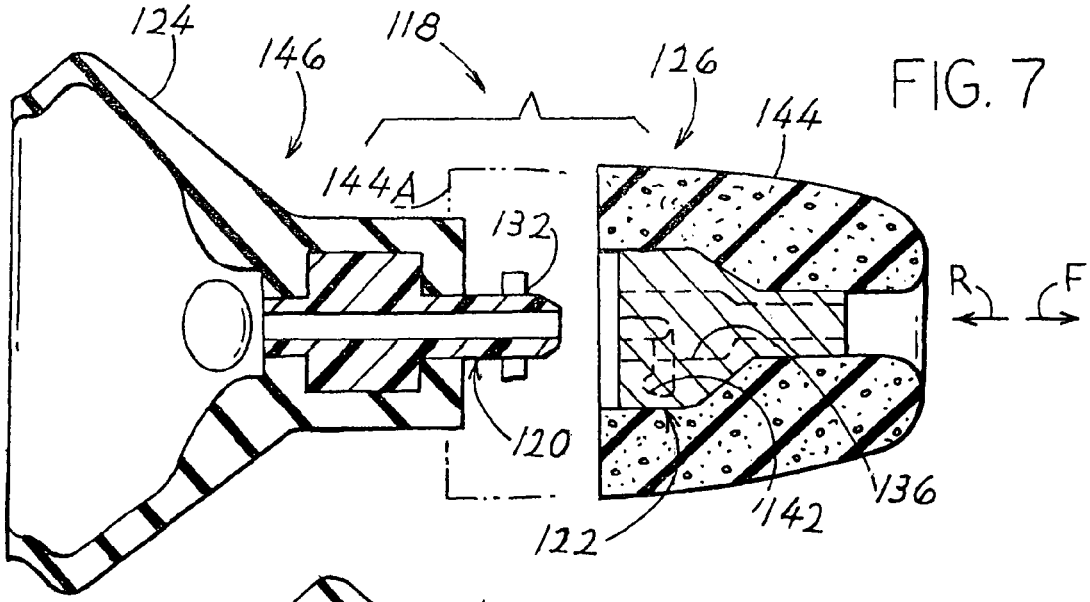
FIG. 7 is an exploded sectional side view of the earbud coupling of FIG. 6, one mount being turned 90°.

FIG. 7 shows the connectors 120, 122 but with the tip 126 turned 90° to show one of the hole extensions 142. When the pins 132 reach the slot extensions 142, the foam body 144 of the tip reaches the position 144A wherein the body has been compressed slightly to resist reverse turning of the connector that would allow their separation.

The connector 120 of the earbud mount is molded of an engineering polymer (a nonelastomeric plastic). A sleeve assembly 146 of an elastomeric material is molded around connector 120. The connector 122 is also formed of an engineering polymer with the body 144 molded around connector 122. Despite large tolerances in manufacture, the pins 132 are very likely to reach the slot extensions 142. Applicant notes that it is known to use a screw connection that requires turning a threaded stud a plurality of turns instead of about one-sixth of a turn (60°). A threaded connection requires maintaining close tolerances along a much longer distance.

Figure 8:
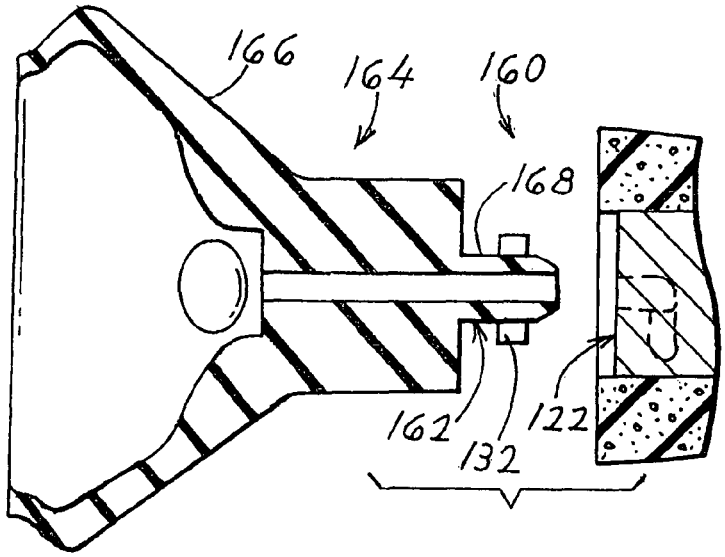
FIG. 8 is a partial exploded sectional view of an earbud coupling of another embodiment, wherein the male latch is formed integrally with the earbud mount, one mount turned 90°.

FIG. 8 shows another earplug coupling 160 with a connector 162 of an earbud mount sleeve assembly 164 molded integrally with the sleeve 166 of the mount. This allows the earbud mount to be molded in one piece and connect to the connector 122, and allows the shaft 168 and pins to deflect slightly to compensate for larger tolerances in manufacture.

Figure 9:
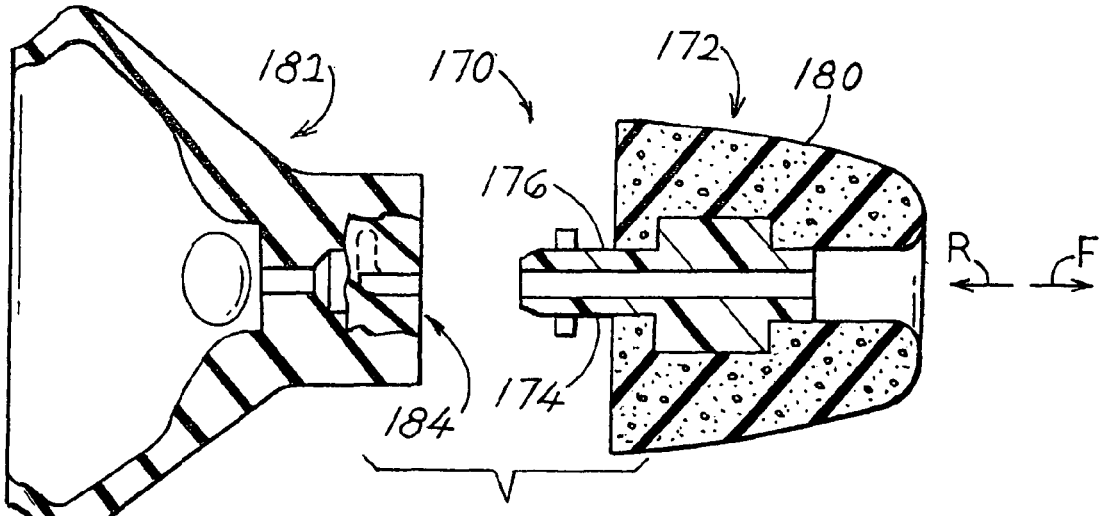
FIG. 9 is an exploded sectional view of an earbud coupling of another embodiment, wherein the female latch is formed integrally with a member of the inear mount, one mount turned 90°.

FIG. 9 shows another earplug coupling 170 wherein the in-ear mount 172 has a rearward projecting connector 176 of engineering plastic bonded to the tip body 180. The earbud mount 182 has a connector portion 184 molded integrally with the rest of the earbud mount. This has the advantage that if the tip 172 should separate from the earbud mount while the tip lies in a person's ear, the shaft 174 can be easily grasped to pull out the tip.

FIG. 10 illustrates an earbud couplings 200 with another design of in-ear mount, or tip 202 that can be mounted on the earbud mount 146. The in-ear mount includes a molded body 204 of solid (non-foam) elastomeric material and a connector 102 of engineering polymer (nonelastomeric). The body 204 of FIG. 10 has flanges 205, 206, 207 and is based on the earplug shown in U.S. patent application Ser. No. 10/778,658. It includes a stem 210 with a rear portion 212 that surround the connector 102. The earbud mount 146 of the coupling has the construction shown in FIG. 7 which also shows the connector 102. FIG. 10 shows that the rear portion 212 of the elastomeric stem extends rearward R of a rear surface 214 of the connector. When the mounts are fully connected, the rear portion at 212A of the stem rear portion is slightly compressed to more reliably hold the mounts together. It also is possible to provide abutting of the earbud coupling front surface 220 with the rear surface 214 of the connector. The stem portion 212 also provides a narrow elongated part that can be grasped to pull the in-ear mount out of a person's ear canal if there is a separation. A variety of flanged bodies can be provided for in-ear mounts with stems that hold a connector 102, such as the design of U.S. Pat. No. D253,723.

A person can install the foam in-ear mount 126 of FIG. 7, the flanged in-ear mount 202 of FIG. 10 or other designs on an earbud mount such as 146 of FIG. 7 and insert the earbud mount in his/her ear (with the earbud mount attached to the earbud). The person can listen to music while moving around, and judge how well the coupling functions. The person then can detach the first in-ear mount and replace if with another in-ear mount and test the new combination. In this way, a person can determine which in-ear mount is best for him/her. Applicant intends to package the earbud coupling with one earbud mount and a plurality of in-ear mounts, with instructions for the purchaser to try out the different in-ear mounts and choose one that fits best.

Thus, the invention provides an earbud coupling that can be manufactured at low cost and that can be easily and securely attached to an earbud. The earbud coupling includes a rear portion forming a sleeve of elastomeric material that is preferably tapered in diameter to be of progressively greater diameter at progressively more rearward locations. The sleeve has a rear part with a reverse taper that lies against a rearwardly-inwardly (with respect to the axis) tapered surface of the earbud. The earbud mount can be formed with a front portion that connects to other in-ear mounts, as when the original one is worn. A plurality of different in-ear mounts can be provided. These include an in-ear mount with a rearwardly projecting small diameter tube of nonelastomeric material, and an in-ear mount formed of a single piece of solid (non-foam) elastomeric material with a rearwardly-projecting stem that lies in an interference fit with a larger diameter part of the earbud mount rear portion. The mounts can be connected by a shaft of one mount that has a plurality of radiating pins, being inserted into a hole with slots in the other mount and being turned.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An earbud coupling (10) for mounting on an earbud (12) that has a front end with a front face (34), a periphery (36), and a convex rear face (32), wherein said earbud coupling (10) has front and rear portions (16, 14) and has an axis (60) extending between said front and rear portions, said earbud coupling having a sound-carrying passage (82, 95) extending along said axis between said front and rear portions, said earbud coupling rear portion forming an earbud mount (14) that attaches to said earbud, wherein: said earbud mount (14) forms a sleeve (50) of elastomeric material that is forcefully expandable to fit around the earbud front end periphery (36) to hold itself: to the earbud, said sleeve having a rear end forming an inner surface (64) that is elastically deformed to lie facewise against said earbud rear face (32), whereby to seal against the entry of environmental sound; and said in-ear mount (16) includes a primarily cylindrical ear canal-blocking piece (90) of elastomeric foam with a through hole (114) lying on said axis, and also includes a tube (92) of nonelastomeric material that is stiffer than said foam, said tube having a front end that lies in said hole of said cylindrical piece and that is bonded to the walls of said hole, and said tube having a rear end that projects a plurality of millimeters rearward of said cylindrical piece into at least one of said earbud mount passages (82) and locks therein.

2. An earbud coupling (118, FIG. 6) for use with an earbud, which includes an earbud mount (124) having a rear end that attaches to said earbud and having a front end, said earbud mount having an axis and a sound-carrying first passage extending along said axis, said earbud coupling also including at least one in-ear mount (126) that has a front end that fits into a person's ear canal to seal thereagainst and that has a rear end that attaches to said front end of said earbud mount, with said in-ear mount having a second passage aligned with said first passage to carry sound from said earbud to the person's ear canal, wherein:

said in-ear mount (126) and said earbud mount (124) are formed with a first one having a first connector in the form of a shaft (130) projecting along said axis towards the other mount, the shaft having a plurality of radially projecting pins (132), and the second mount has a second connector in the form of a wall forming a hole (136) that receives the shaft with the hole having a plurality of slots (140) radiating from the hole for receiving the pins, with said slots having angular slot extensions (142) that receive the pin when the shaft is fully inserted into the hole and turned.

3. The earbud coupling described in claim 2 wherein:

said mounts have abutting surfaces that abut when said pins lie in said slot extensions, with at least one of said mount surfaces (144A) being of elastomeric material that is compressed when said abutting surfaces abut.

4. An earbud coupling (10) mounted on an earbud (12) that has a front end with a front face (34), a periphery (36), and a convex rear face (32), wherein said earbud coupling (10) has front and rear portions (16, 14) and has an axis (60) extending between said front and rear portions, said earbud coupling having a sound-carrying passage (82, 95) extending along said axis between said front and rear portions, said earbud coupling rear portion forming an earbud mount (14) that attaches to said earbud, wherein:

said earbud mount (14) forms a sleeve (50) of elastomeric material that is forcefully expanded to fit around the earbud front end periphery (36) to hold itself to the earbud, said sleeve having a rear end forming an inner surface (64) that is elastically deformed to lie facewise against said earbud rear face (32), whereby to seal against the entry of environmental sound;

said sleeve (50) has a rear face (71) that faces towards said ear bud front face (34) and that has at least one rearward projection (70) that contacts a minority of the area of said earbud front face, to leave a space for sound to reach said passage.

5. The earbud coupling described in claim 4, wherein:

said rear face (71) has a plurality of projections (70) that are all spaced from said axis, to leave open a region forward of the middle of said earbud front face.

6. A combination of an ear bud (12) that has a speaker with a convex rear face (32), that has a front face (34) with a periphery (36) lying around said speaker front face, and an earbud coupling (10) with a rear end (56) attached to said ear bud and a front end (16) that fits in a person's ear canal to support the combination and to block environmental noise from entering the ear canal, the earbud coupling having a passage extending from said rear end to said front end, wherein:

said earbud coupling includes an earbud mount (14) with a rear that includes a sleeve (50) of elastomeric material that is stretched to fit around said periphery (36) of said speaker, said sleeve having a rear edge and having an inner surface (64) that lies facewise against said convex rear face (32) to seal against the entrance of noise that is not from said earbud, said sleeve having a rear face with at least one rearward projection (70) that contacts a minority of the area of said earbud front face (34) to leave a space for sound to reach said passage.

* * * * *